US012221907B2

(12) United States Patent
Oberwalder et al.

(10) Patent No.: US 12,221,907 B2
(45) Date of Patent: Feb. 11, 2025

(54) APPARATUS AND METHOD FOR CONVERTING THERMAL ENERGY

(71) Applicant: ENERSCALE GMBH, Afritz am See (AT)

(72) Inventors: Hermann Oberwalder, Afritz am See (AT); Gerhard P. Fleischer, Schiefling am Wörthersee (AT)

(73) Assignee: ENERSCALE GMBH, Afritz am See (AT)

( * ) Notice: Subject to any disclaimer, the term of this patent is extended or adjusted under 35 U.S.C. 154(b) by 0 days.

(21) Appl. No.: 18/421,597

(22) Filed: Jan. 24, 2024

(65) Prior Publication Data

US 2024/0159169 A1 May 16, 2024

Related U.S. Application Data

(63) Continuation of application No. 18/027,531, filed as application No. PCT/AT2021/060317 on Sep. 7, 2021, now Pat. No. 12,006,849.

(30) Foreign Application Priority Data

Sep. 28, 2020 (AT) ..... 50816/2020

(51) Int. Cl.
*F01K 7/16* (2006.01)
*F01K 7/12* (2006.01)
(Continued)

(52) U.S. Cl.
CPC ..... *F01K 7/16* (2013.01); *F01K 7/12* (2013.01); *F01K 7/32* (2013.01); *F01K 19/10* (2013.01); *F01K 25/103* (2013.01); *F01K 3/14* (2013.01)

(58) Field of Classification Search
CPC ..... F01K 7/12; F01K 7/16; F01K 7/32; F01K 25/10; F01K 25/103; F01K 19/10; F01K 3/14
See application file for complete search history.

(56) References Cited

U.S. PATENT DOCUMENTS 3,736,745 A * 6/1973 Karig ..... F02C 3/34 60/39.52
4,362,020 A * 12/1982 Meacher ..... F01D 25/22 60/657

(Continued)

FOREIGN PATENT DOCUMENTS

CL 202202567 9/2022
CN 102817799 12/2012

(Continued)

OTHER PUBLICATIONS

Chile Office Action conducted in counterpart Chile Appln. No. 202300869 (Sep. 2, 2024).

*Primary Examiner* — Loren C Edwards
(74) *Attorney, Agent, or Firm* — GREENBLUM & BERNSTEIN, P.L.C.

(57) ABSTRACT

An apparatus for converting thermal energy into mechanical energy by a cycle, having a heat exchanger, a reservoir for an operating medium, a feed line, a turbine, and a return line having at least one recovery device. To utilize waste heat for the generation of electrical energy, the turbine is embodied as a disc rotor turbine with full condensation of the operating medium, whereby a separate condenser can be eliminated.

22 Claims, 2 Drawing Sheets

(51) Int. Cl.

| | |
|---|---|
| ***F01K 7/32*** | (2006.01) |
| ***F01K 19/10*** | (2006.01) |
| ***F01K 25/10*** | (2006.01) |
| *F01K 3/14* | (2006.01) |

(56) References Cited

U.S. PATENT DOCUMENTS

| | | | | |
|---|---|---|---|---|
| 11,905,857 | B2 | 2/2024 | Spadacini | |
| 2007/0044473 | A1* | 3/2007 | Yatsuzuka | F01K 13/006 60/645 |
| 2013/0341430 | A1* | 12/2013 | Hall | F02M 61/167 239/533.2 |
| 2014/0271120 | A1* | 9/2014 | Cochran | F01D 5/181 415/1 |

FOREIGN PATENT DOCUMENTS

| | | | | |
|---|---|---|---|---|
| CN | 102817799 | A * | 12/2012 | Y02B 10/20 |
| DE | 101 26 403 | | 12/2001 | |
| DE | 202010008126 | | 1/2012 | |
| EP | 2 415 976 | | 2/2012 | |
| EP | 2415976 | A1 * | 2/2012 | F01K 25/10 |
| EP | 3 056 694 | | 8/2016 | |
| WO | 2021/191786 | | 9/2021 | |

* cited by examiner

APPARATUS AND METHOD FOR CONVERTING THERMAL ENERGY

CROSS-REFERENCE TO RELATED APPLICATION

This application is a Continuation of U.S. patent application Ser. No. 18/027,531, which is a U.S. National Stage of International Application No. PCT/AT2021/060317 filed Sep. 7, 2021 claiming priority under 35 U.S.C. § 119(a) and 364 to Austria Application No. A 50816/2020 filed Sep. 28, 2020, the disclosures of which are expressly incorporated by reference herein in their entireties.

BACKGROUND

1. Field of the Invention

The invention relates to an apparatus for converting thermal energy into mechanical energy by a cycle, having a heat exchanger, a reservoir for an operating medium, a feed line, a turbine, and a return line having at least one recovery device.

The invention furthermore relates to a method for converting thermal energy into mechanical energy in a cycle, wherein thermal energy is supplied to an operating medium in a reservoir, wherein the operating medium evaporates and/or a pressure in the operating medium is increased, whereupon the operating medium releases energy in a turbine, after which the operating medium is returned to the reservoir.

2. Discussion of Background Information

To convert heat into mechanical energy, and possibly further into electrical energy, cycles such as a Rankine cycle are known in particular. Here, an energy-carrier medium or operating medium undergoes a phase change, wherein water is normally used as an operating medium. One variant of the Rankine cycle uses a liquid with a low boiling point. There is also a manner of operation using a supercritical state of the operating medium. That means, the operating medium does not leave the supercritical state, and there is therefore no phase change in the system, whereby the condensation effect is also not utilized. Because of a single-phase cycle achieved as a result, a great deal of work must be expended in order to pump the medium back into a storage tank or reservoir, which is detrimental an overall efficiency of the system.

A cycle is also known from EP 3 056 694 A1, for example, which operates using refrigerants and comprises at least two heated pressure vessels and one additional heat source as a thermal condensation pump.

DE 101 26 403 A1 describes a system with two pressure vessels, wherein a gas is respectively used for buffering in a chamber above the operating medium.

SUMMARY

The present invention is intended to avoid the disadvantageous of the prior art and to specify an apparatus which enables the use of energy sources having a low temperature, for example starting at 40° C., for the emission-free and efficient generation of mechanical energy, and consequently electrical energy, and requires a low equipment cost.

Furthermore, a corresponding method will also be specified.

According to the invention, the first object is attained by an apparatus of the type named at the outset in which the turbine is embodied as a disc rotor turbine.

In an apparatus of this type, operating media can be used which have a low boiling point and can thus also absorb heat starting at approximately 40° C., wherein waste heat or solar energy can thus also be highly beneficially used as a heat source. Thus, through the use of a disc rotor turbine, which is also referred to as a boundary-layer turbine or Tesla turbine, a condensation of the operating medium can also occur in the turbine itself, whereby a separate condenser or second pressure vessel can be eliminated.

The disc rotor turbine used typically comprises multiple discs rotatably arranged next to one another on an axle in a casing. A stream of the operating medium, typically water, is preferably conducted parallel to the discs onto said discs through an inlet opening in the casing. Due to an adhesion force, the discs are then set in rotational motion about the axle. The stream is furthermore decelerated by a friction on the discs. Side walls of the casing redirect the stream onto a circular path, wherein the discs continue to be driven. A velocity of the stream is thereby reduced, whereby the stream cools and a condensation occurs in the turbine.

Because a higher viscosity arises due to the condensation of the operating medium, the discs are also driven more powerfully as a result. In typical turbines with blades, a condensation would severely damage said blades.

Because no highly resilient materials are thereby required, the production costs are also low and a long service life is achieved.

The recovery device can in principle be embodied in any manner known from the prior art, for example as a pump.

It is beneficial if the turbine embodied as a disc rotor turbine comprises multiple discs rotatably arranged next to one another on an axle in a casing, wherein the surfaces of the discs are provided with microstructures. Optimal properties of a surface friction layer for maintaining a laminar flow can thus be achieved.

It has proven particularly advantageous if the turbine embodied as a disc rotor turbine comprises multiple discs rotatably arranged next to one another on an axle in a casing and, in the casing, comprises an inlet nozzle holder having a geometry that enables an injection of the operating medium between the discs. Disruptions of the flow, and resulting losses due to impact on the faces of the discs, can thus be avoided.

Furthermore, it has proven beneficial if the turbine embodied as a disc rotor turbine comprises multiple discs rotatably arranged next to one another on an axle in a casing and, in the casing, comprises an inlet nozzle holder having a geometry that enables a generation of a rotating stream of the operating medium. A double-helix stream that improves a surface friction layer effect is thus obtained.

It is advantageously provided that a structure-borne noise measurement is integrated into the turbine for identifying laminar and turbulent flow. The cycle can thus be controlled such that a laminar flow is present in the turbine to the greatest possible extent and losses due to turbulence are thus avoided. A control can occur, for example, in that a flow through the turbine is altered by a corresponding control device, in particular by a controllable valve.

To control the cycle, it is preferably envisaged that a valve is provided for regulating a flow rate. By a valve position, it is then possible to regulate, for example, a rotational speed of the turbine and/or an outputted electrical power. For example, the flow rate can be regulated such that a laminar flow is maintained in the turbine.

It is beneficial if the turbine can be, in particular is, connected to a generator. As a result, mechanical energy obtained can easily be converted into electricity, wherein previously unutilized waste heat or solar thermal energy can be used for this purpose.

It is particularly advantageous if the generator can be, in particular is, integrated into the turbine. As a result, the system becomes more compact and connection problems between the turbine and generator can be avoided.

It has proven beneficial if the reservoir for the operating medium can be connected to a heat source via a heat exchanger located in particular in the interior of the reservoir. It is thus possible to transfer the heat to the operating medium in very beneficial manner.

It is preferably provided that $CO_2$ is used as an operating medium. Due to the low evaporation temperature of $CO_2$, the thermal energy, for example from waste heat, can already be absorbed at a low pressure. The $CO_2$ then evaporates, for example with an absorption of thermal energy in the reservoir, whereupon it reaches the turbine via the feed line, in which turbine the gaseous $CO_2$ condenses with a release of mechanical energy, after which the liquid $CO_2$ is transported by the recovery device into the reservoir, which is under a higher pressure than the turbine outlet, in which reservoir an evaporation once again takes place through a supply of heat.

Normally, the operating medium is present in an at least partially liquid, preferably solely liquid, form between the turbine outlet and the reservoir, especially since a condensation can occur in the turbine.

It has proven effective that the apparatus is designed for a pressure of the operating medium at the turbine of more than 74 bar, preferably more than 100 bar, in particular to enable a supercritical state of the operating medium at the turbine.

Particularly if $CO_2$ is used an operating medium, a supercritical state can then already be achieved at low temperatures of 40° C., for example, whereby waste heat accumulating at correspondingly low temperatures can also be utilized. The turbine or the apparatus is then preferably designed so that a condensation of the operating medium from the supercritical state to the gaseous and to the liquid state occurs in the turbine.

It is beneficial if at least one valve is provided between the turbine and the reservoir and the recovery device is embodied to generate a chronologically alternating force on the operating medium, in order to generate a pressure vibration in the operating medium. By applying a force or pressure vibration to the operating medium between the turbine outlet and the reservoir, the operating medium can be set in a vibration or oscillation, wherein a rise occurs in particular in a range of a resonant frequency of the operating medium and particularly high pressure amplitudes can thus be achieved. With a pressure amplitude of this type, a pressure difference between the reservoir and the turbine outlet can be overcome so that the medium can be conveyed into the reservoir or boosted to a higher pressure level in a particularly efficient manner, namely even if the medium is already present in a solely liquid form starting from the turbine outlet, that is, if a full condensation takes place in the turbine. As a result, a method with particularly high efficiency can be realized with the apparatus.

The recovery device can in principle be embodied in the widest variety of ways, for example as an electromagnetic device with which a force or a pressure can be applied to the operating medium with a defined amplitude and frequency, for example with an electromagnetically actuated membrane or an electromagnetically actuated piston.

Preferably, a force can be applied to the operating medium at a frequency of more than 1 Hz, in particular more than 10 Hz, preferably more than 100 Hz, particularly preferably more than 1000 Hz, using the recovery device in order to be able to excite a resonant frequency of the operating medium in the apparatus.

The recovery device can also comprise a pressure measuring device with which, for example, a pressure in the operating medium between the turbine outlet and the reservoir can be measured, for example in order to iteratively determine a frequency at which a resonance of the operating medium is present and to apply in a targeted manner a force excitation to the operating medium at said frequency, so that high pressure amplitudes can be achieved with little effort in order to overcome the pressure difference between the reservoir and turbine in a simple manner.

It is advantageously provided that the recovery device is embodied as a resonant tube system. The operating medium can thus be set in oscillation in a simple manner, preferably in an oscillation at a resonant frequency, and thus a pressure difference between a return line of the turbine and a feed line between the reservoir for the operating medium and the turbine can be overcome.

In order to avoid a backflow of the operating medium from the reservoir to the turbine outlet, at least one valve is typically provided between the turbine outlet and the reservoir, which valve permits only a flow from the turbine outlet to the reservoir and prevents a flow in the opposite direction. A valve of this type can also be referred to as a one-way valve. This valve can also be used to regulate a flow rate, though a separate valve or a different control device can also be provided for this purpose.

Particularly preferably, it is provided that at least one valve for controlling the flow direction of the operating medium is provided before or after the recovery device, wherein the at least one valve is preferably embodied as a valve without moving parts. A durability and a low maintenance requirement of the system can thus be facilitated.

Particularly preferably, what is referred to as a Tesla valve is used in this case, which valve comprises no moving parts, wherein a valve effect is achieved in that a flow through the valve in different directions has a different flow resistance, so that practically only a flow in one direction is possible.

One variant that is beneficial is if the recovery device comprises a spring-loaded, undamped mass, for example a piston or a membrane, wherein the mass can alternatively also be damped. With a mass of this type in a closed volume, the vibration can beneficially be excited and be brought into resonance, wherein an amplitude proceeds to rise and a pressure difference between a return line of the turbine and a feed line between the reservoir for the operating medium and the turbine can thus be overcome.

Typically, vibrations or oscillations at a frequency of several Hz up to 10 kHz are generated in the operating medium using the recovery device. The vibrations are generated by supplied energy, with which a piston or a membrane are cyclically driven, for example.

An advantageous alternative variant of the apparatus is that the recovery device comprises field coils which generate a magnetic or electromagnetic field, wherein said coils can be located in an interior of a closed volume or outside of a closed volume. With these field coils, which are fed with electrical energy, the generation of vibrations and a resonance can be very effectively regulated, in particular if a magnetic fluid is used as an operating medium. A pressure difference between a return line of the turbine and a feed line between the reservoir for the operating medium and the turbine can thus be beneficially overcome.

The closed volume on which the field coils act can be, for example, a segment of the return line or a connecting line between the turbine outlet and reservoir, in order to generate vibrations in the operating medium at said locations. For this purpose, a magnetic medium can be used as an operating medium. Alternatively, the vibration can also be indirectly introduced into the operating medium by a magnetic medium.

The field coils can thus be arranged in a return line that connects the turbine outlet and the reservoir, or outside of said return line, in order to act on a medium located in the return line, which is preferably embodied as a magnetic medium or magnetic fluid. For this purpose, magnetic particles with a size of a few nanometers can be admixed to the operating medium, for example.

According to the invention, the other object is attained by a method of the type named at the outset, wherein a condensation of the operating medium occurs in the turbine.

A condensation energy can thus also be obtained, whereby a particularly high efficiency can be achieved even at low temperatures. In this case, a disc rotor turbine is typically used, which is also known as a boundary-layer turbine or Tesla turbine.

Advantageously, $CO_2$ is used as an operating medium. As a result, heat sources with very low temperatures can also be used.

It is beneficial if the operating medium, in particular $CO_2$, absorbs the thermal energy at a pressure of up to 73 bar, preferably 65 bar to 73 bar, and thereby evaporates. A pressure in the reservoir can thus be 72 bar, for example, so that heat can be absorbed at a temperature of 40° C., for example, with evaporation of the operating medium taking place. As a rule, a pressure at the turbine outlet is lower than in the reservoir. Thus, the operating medium at the turbine outlet can, for example, be present in liquid form at a pressure of approximately 64 bar and 20° C.

Alternatively or additionally, it can be provided that the operating medium reaches a supercritical state, in particular at a pressure of more than 74 bar, preferably at a pressure of more than 100 bar, and that a condensation from the supercritical state to a gaseous state and a liquid state takes place in the turbine. Particularly when $CO_2$ is used as an operating medium, this is already possible at comparatively low temperatures, so that waste heat accumulating at low temperatures can be utilized in this case.

Even if a supercritical state is reached, it is preferably provided that a full condensation of the operating medium to the liquid, possibly also at least partially to the solid, state takes place in the turbine.

If pressure and temperature are measured in a return line and compared with a pressure and a temperature in a feed line, wherein a flow rate of the operating medium in the return line is regulated by a valve arranged in the return line, a very good load regulation can be achieved in an especially beneficial manner with simultaneously low complexity. For this purpose, the flow rate is typically regulated by a valve that is preferably arranged between the turbine outlet and the reservoir.

It is beneficial if a return of the operating medium from the turbine to the reservoir takes place with a pressure increase in the operating medium by a recovery device with which a chronologically alternating force is applied to the operating medium.

Typically, a valve is provided in a return line between the turbine outlet and reservoir so that, for every pressure vibration in which an amplitude exceeds a pressure in the reservoir, operating medium is conveyed into the reservoir, but no backflow from the reservoir to the turbine outlet occurs due to the valve.

As a result, a pressure difference between the turbine and reservoir can be overcome in a simple manner, so that a particularly high efficiency is achieved and a utilization of waste heat is also possible at a temperature of 40° C., for example.

It has proven particularly advantageous that the operating medium is set in oscillation by the recovery device, in particular in a vibration at a resonant frequency of the operating medium. The pressure difference between a return line of the turbine and a feed line between the reservoir for the operating medium and the turbine can thus be overcome in a particularly beneficial and simple manner Typically, the operating medium is present in a solely liquid form in a region of the recovery device, for which reason a resonant frequency is normally more than 1 kHz.

In order to generate a beneficial oscillation of the operating medium, a spring-loaded and possibly damped mass is provided by a resonant tube system, or by a magnetic fluid that is set in vibration by an alternating magnetic field. To generate the vibrations, external energy is normally used, though the vibrations can, of course, also be generated with energy that is produced by the turbine or a generator connected to the turbine.

Embodiments are directed to an apparatus for converting thermal energy into mechanical energy by a cycle. The apparatus includes a heat exchanger, a reservoir for an operating medium, a feed line, a turbine, and a return line having at least one recovery device. The turbine is embodied as a disc rotor turbine with full condensation of the operating medium, whereby a separate condenser can be eliminated.

According to embodiments, the disc rotor turbine may include multiple discs rotatably arranged next to one another on an axle in a casing, and surfaces of the multiple discs can be provided with microstructures.

In embodiments, the disc rotor turbine may include multiple discs rotatably arranged next to one another on an axle in a casing, and the casing can include an inlet nozzle holder having a geometry that enables an injection of the operating medium between the multiple discs.

In accordance with embodiments, the disc rotor turbine may include multiple discs rotatably arranged next to one another on an axle in a casing, and the casing can include an inlet nozzle holder having a geometry that enables a generation of a rotating stream of the operating medium.

In other embodiments, a structure-borne noise measurement may be integrated into the disc rotor turbine for identifying laminar and turbulent flow.

According to still other embodiments, a valve can be provided for regulating a flow rate.

In accordance with other embodiments, the reservoir for the operating medium can be connectable to a heat source via a heat exchanger.

According to other embodiments, the operating medium may include $CO_2$.

In other embodiments, the apparatus can be designed for a pressure of the operating medium at the disc rotor turbine of more than 74 bar to enable a supercritical state of the operating medium in the turbine. Preferably, the apparatus can be designed for a pressure of the operating medium at the disc rotor turbine of more than 100 bar to enable a supercritical state of the operating medium in the turbine.

In accordance with other embodiments, at least one valve may be provided between the turbine and the reservoir, and the recovery device can be embodied to generate a chronologically alternating force on the operating medium, in order to generate a pressure vibration in the operating medium.

According to still other embodiments, the recovery device can be embodied as a resonant tube.

According to other embodiments, the recovery device may include a spring-loaded, undamped mass. Further, the spring-loaded, undamped mass can include a piston or a membrane.

In still other embodiments, the recovery device may include a spring-loaded, damped mass. Further, the spring-loaded, damped mass can include a piston or a membrane.

In accordance with other embodiments, the recovery device can include field coils which generate a magnetic field. The field coils may be arranged in an interior of a closed volume. Further, the field coils can be arranged outside of a closed volume.

In accordance with still yet other embodiments, at least one valve, which can be arranged between a turbine outlet and the reservoir, is configured to enable a flow of the operating medium from the turbine outlet to the reservoir and to prevent a flow in the opposite direction. The at least one valve may be embodied as a valve without moving parts. Further, the at least one valve can include a Tesla valve.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION

Figure 1:
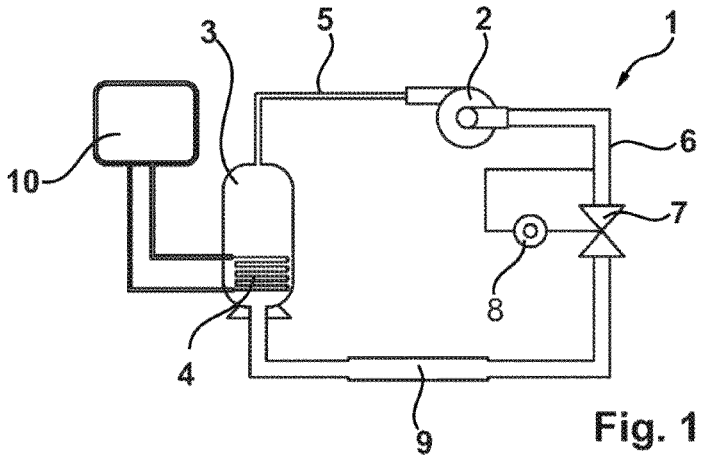
FIG. 1 shows an apparatus according to the invention.

FIG. 1 shows a diagram of an apparatus 1 according to the invention for carrying out a cycle according to the invention, wherein heat is converted into mechanical energy and further into electrical energy.

The apparatus 1 is essentially composed of a turbine 2, a reservoir 3 for the operating medium, a heat exchanger 4, a feed line 5 between the reservoir 3 and turbine 2 in order to convey an operating medium from the reservoir 3 to the turbine 2, a return line 6 after the turbine 2 in order to convey the operating medium from a turbine outlet back to the reservoir 3, a valve 7 for regulating a flow.

Furthermore, a pressure sensor 8 is provided with which the valve 7 can be controlled.

In order to convey the operating medium from the turbine outlet to the reservoir 3, wherein a higher pressure prevails in the reservoir 3 than at the turbine outlet, a recovery device 9 is provided in the return line 6.

$CO_2$ is preferably used as an operating medium, since it has a low boiling point. The critical point is at 31° C. and 73.9 bar. For $CO_2$, a phase transition between liquid and gaseous already occurs at a pressure of approximately 72 bar at a temperature of only 30° C., whereby a phase transition can be utilized for energy absorption and release even with a heat supplied at low temperatures. Thus, the operating medium in the reservoir can be present, for example, at a pressure of 72 bar, wherein waste heat is supplied thereto at a temperature of 40° C. by the heat exchange, wherein the operating medium evaporates, whereupon it is depressurized to a pressure of approximately 64 bar in the turbine, thereby cooling to an ambient temperature of 20° C., for example, and fully condensing, wherein work is outputted via the turbine.

Alternatively, it can also be provided that the operating medium is present in the reservoir (3) at a pressure of more than 74 bar, for example at approximately 100 bar, and reaches a supercritical state through a supply of heat, from which state it fully condenses to a gaseous state and, simultaneously or subsequently, to a liquid state in the turbine (2).

With corresponding pressure conditions in the apparatus (1), it can also be provided that an at least partial phase transition of the operating medium to a solid state takes place in the turbine at a temperature of 20° C., for example, so that dry ice particles form which are also unproblematic for the turbine (2) due to the use of a disc rotor turbine. As a result, heat accumulating at a low temperature of only 40° C., for example, can also be utilized to generate electricity.

Of course, other operating media such as refrigerants can also be used, for example R744 or R134a.

The heat from a heat source 10 is supplied to the operating medium via a heat exchanger 4 arranged in the reservoir 3. Either primary energy or preferably waste heat, for example from an industrial process, with a temperature of approximately 40° C. can thereby be used. Heat sources 10 with a lower temperature can also be used, however. It is thus especially beneficial that solar energy can also be utilized.

A disc rotor turbine is used as a turbine 2. This is also known as a boundary-layer turbine 2 or Tesla turbine 2. This disc rotor turbine comprises multiple discs rotatably arranged next to one another on an axle, which are arranged in a casing with side walls, an inlet opening, and an outlet opening. A stream of the operating medium, up to now usually water, is conducted parallel to the discs onto said discs through the inflow opening. Due to an adhesion force, the discs are then set in motion about the axle. The stream is decelerated by a friction. The stream is redirected onto a circular path by the side walls and thereby continues to drive the discs. Since only the bearings of the axle need to have low tolerances and no highly resilient materials are required, the production costs are also low and a long service life can be expected. Because a higher viscosity arises due to the condensation of the operating medium in the turbine 2, the discs are also driven more powerfully as a result. In typical turbines 2 with blades, a condensation would severely damage said blades. The energy extraction then subsequently takes place by a pressure reduction in the operating medium in the turbine 2.

To control the cycle, pressure and temperature are measured at the turbine outlet in the return line 6 and compared with the pressure and the temperature in the feed line 5. The cycle can thereupon be regulated via a valve 7 arranged in the return line 6 in order to regulate the flow rate. In this manner, a very good load regulation is possible with simultaneously low complexity.

The operating medium is then supplied to a recovery device 9 after the valve 7, which device is embodied as a pump in this case.

In the exemplary embodiments illustrated in FIG. 2 through FIG. 6, the recovery device 9 is embodied to set the operating medium in vibration in order to overcome a pressure difference between the turbine outlet and the reservoir 3.

Figure 2:
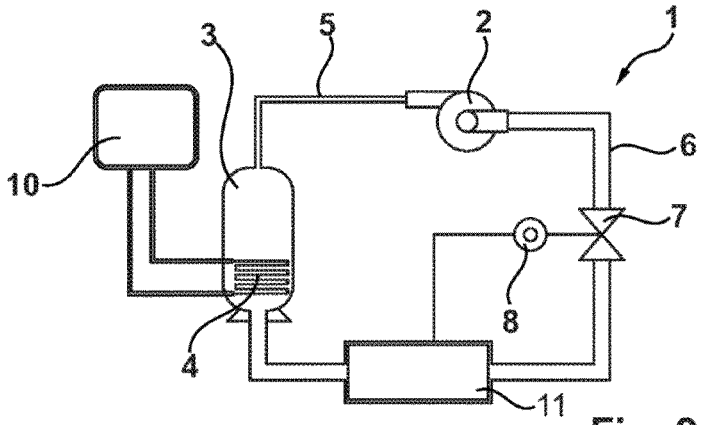
FIG. 2 shows an apparatus according to the invention with a resonant tube system.

FIG. 2 shows an apparatus 1 according to the invention with a recovery device 9 embodied as a resonant tube 11. Here, a fluid column of the operating medium can vibrate back and forth in a volume 12 in a pipe-like form, and can thus be in self-resonance, for example, and, in combination with a valve, can therefore overcome the pressure difference between the return line 6 of the turbine 2 and the feed line 5 between the reservoir 3 for the operating medium and the turbine 2. A vibration excitation can, for example, occur by an electromagnetically driven membrane.

Figure 3:
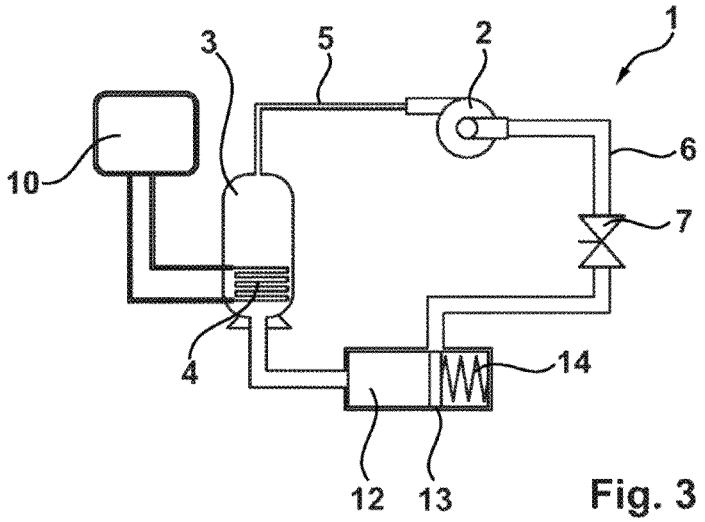
FIG. 3 shows an apparatus according to the invention with a spring-loaded, undamped mass.

In FIG. 3, a further variant of an apparatus 1 according to the invention is illustrated with a spring-loaded mass 13. Here, using this mass 13, which can be a membrane, for example also a piston, inside a closed volume 12, the vibrations are excited in the operating medium and the operating medium is brought into resonance in the volume, which causes the amplitude to proceed to rise accordingly. In the state of resonance, only a fraction of the excitation energy originally used is required, which leads to an improved efficiency and ensures a particularly efficient transport of the operating medium into the reservoir 3. Here, the closed volume 12 is illustrated as a cylinder in which the mass 13 can vibrate by a spring 14. The vibrations are thereby generated through the use of external energy, for example electromechanical energy.

Figure 4:
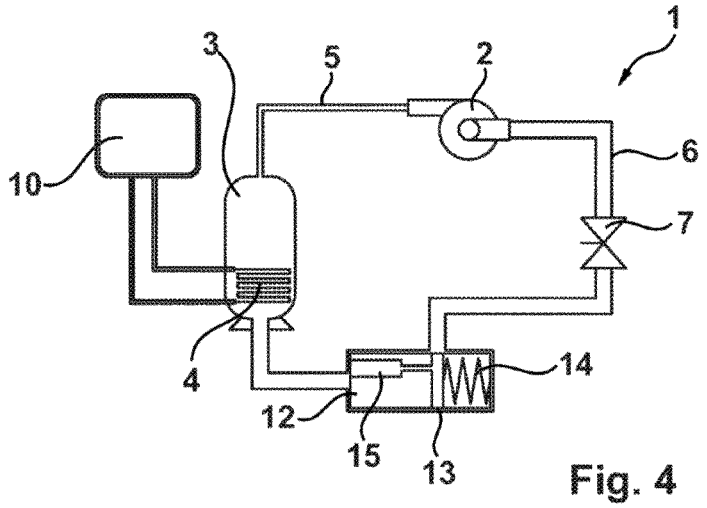
FIG. 4 shows an apparatus according to the invention with a spring-loaded and damped mass.

FIG. 4 shows an apparatus 1 similar to that illustrated in FIG. 3. Here, however, the mass 13 is hindered from excessive amplitudes, which could have negative effects in the system, by a damper 15. Nevertheless, a pressure difference between the return line 6 of the turbine 2 and the feed line 5 between the reservoir 3 for the operating medium and the turbine 2 can also be overcome easily in this case.

Figure 5:
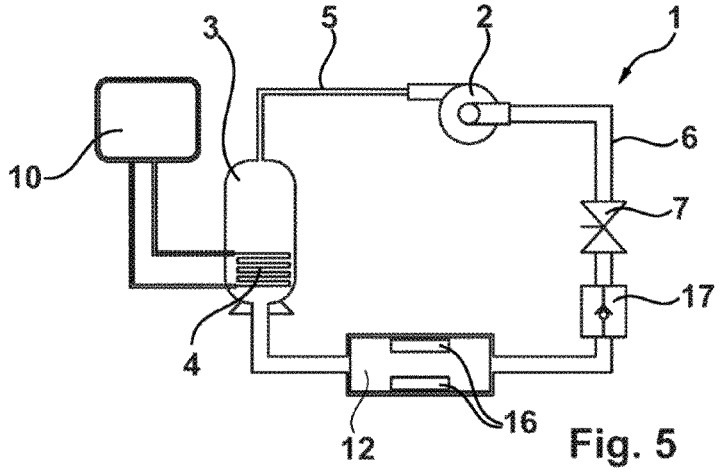
FIG. 5 shows an apparatus according to the invention with field coils inside a closed volume.

A further possibility for generating an oscillation is illustrated in FIG. 5. Here, the oscillation is generated by a magnetic fluid which is set in vibration by field coils 16, wherein an alternating electromagnetic field can be generated with the field coils 16.

To control the flow direction of the operating medium, an additional one-way valve 17 is provided in this case between the valve 7, which is only used here to regulate the flow rate, and the recovery device 9. Alternatively, the flow direction in the apparatus 1 can, of course, also be ensured by a correspondingly embodied valve 7, so that no additional one-way valve 17 is required.

The one-way valve 17 can, similarly to the valve 7, of course also be provided after the recovery device 9, or between the recovery device 9 and the reservoir 3.

In the variant according to FIG. 5, the field coils 16 are arranged inside a closed volume 12.

Figure 6:
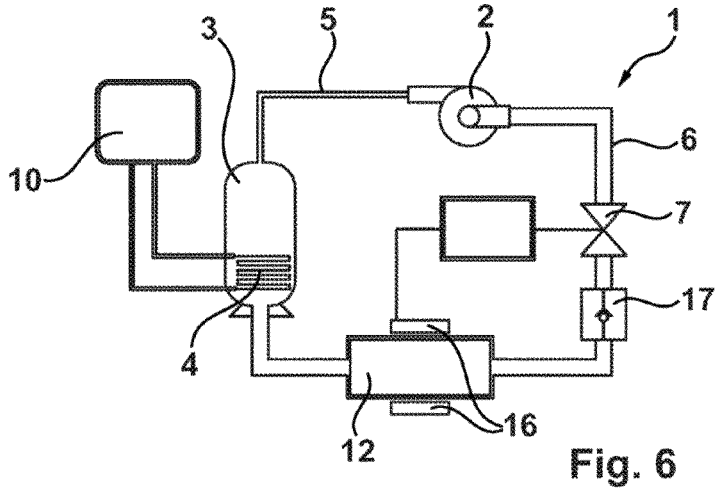
FIG. 6 shows an apparatus according to the invention with field coils outside a closed volume.

A similar variant is illustrated in FIG. 6, although here, in contrast to FIG. 5, the field coils 16 are arranged outside the closed volume 12, for example a cylinder. Because the electromagnetic field generated using the field coils 16 can penetrate into the volume 12, a vibration excitement of the magnetic fluid is also possible here.

With the apparatus 1 described above and the method according to the invention, previously unutilized waste heat can be converted into electrical energy under economically beneficial conditions. For example, industrial waste heat in the temperature range of approximately 40° C. to over 300° C. can thereby be used for conversion into electricity. Solar heat can also be utilized for additional electricity generation. Because the system is inherently closed, it can also be used beneficially and advantageously in remote regions without connection to other power supply lines.

What is claimed:

1. An apparatus for converting thermal energy into mechanical energy by a cycle, comprising:

a heat exchanger, a reservoir for an operating medium, a feed line, a turbine, and a return line having at least one recovery device, wherein the turbine is embodied as a disc rotor turbine configured to perform full condensation of the operating medium without a separate condenser such that the disc rotor turbine receives the operating medium in a gaseous state and outputs the operating medium solely in the liquid state, the solid state, or a combination thereof.

2. The apparatus according to claim 1, wherein the disc rotor turbine comprises multiple discs rotatably arranged next to one another on an axle in a casing, and wherein surfaces of the multiple discs are provided with microstructures.

3. The apparatus according to claim 1, wherein the disc rotor turbine comprises multiple discs rotatably arranged next to one another on an axle in a casing, and the casing comprises an inlet nozzle holder having a geometry that enables an injection of the operating medium between the multiple discs.

4. The apparatus according to claim 1, wherein the disc rotor turbine comprises multiple discs rotatably arranged next to one another on an axle in a casing and the casing comprises an inlet nozzle holder having a geometry that enables a generation of a rotating stream of the operating medium.

5. The apparatus according to claim 1, wherein a structure-borne noise measurement is integrated into the disc rotor turbine for identifying laminar and turbulent flow.

6. The apparatus according to claim 1, wherein a valve is provided for regulating a flow rate.

7. The apparatus according to claim 1, wherein the reservoir for the operating medium is connectable to a heat source via a heat exchanger.

8. The apparatus according to claim 1, wherein the operating medium comprises $CO_2$.

9. The apparatus according to claim 1, wherein the apparatus is designed for a pressure of the operating medium at the disc rotor turbine of more than 74 bar to enable a supercritical state of the operating medium in the turbine.

10. The apparatus according to claim 9, wherein the apparatus is designed for a pressure of the operating medium at the disc rotor turbine of more than 100 bar to enable the supercritical state of the operating medium in the turbine.

11. The apparatus according to claim 1, wherein at least one valve is provided between the turbine and the reservoir, and the recovery device is embodied to generate a chronologically alternating force on the operating medium, in order to generate a pressure vibration in the operating medium.

12. The apparatus according to claim 1, wherein the recovery device is embodied as a resonant tube.

13. The apparatus according to claim 1, wherein the recovery device comprises a spring-loaded, undamped mass.

14. The apparatus according to claim 13, wherein the spring-loaded, undamped mass comprises a piston or a membrane.

15. The apparatus according to claim 1, wherein the recovery device comprises a spring-loaded, damped mass.

16. The apparatus according to claim 15, wherein the spring-loaded, damped mass comprises a piston or a membrane.

17. The apparatus according to claim 1, wherein the recovery device comprises field coils which generate a magnetic field.

18. The apparatus according to claim 17, wherein the field coils are arranged in an interior of a closed volume.

19. The apparatus according to claim 17, wherein the field coils are arranged outside of a closed volume.

20. The apparatus according to claim 1, wherein at least one valve is arranged between a turbine outlet and the reservoir, the at least one valve being configured to enable a flow of the operating medium from the turbine outlet to the reservoir and to prevent a flow in the opposite direction.

21. The apparatus according to claim 20, wherein the at least one valve is embodied as a valve without moving parts.

22. The apparatus according to claim 20, wherein the at least one valve comprises a Tesla valve.

* * * * *